United States Patent [19]

Hawes, Jr. et al.

[11] Patent Number: 5,052,646

[45] Date of Patent: Oct. 1, 1991

[54] LONG TIP HANGING FOLDER RODS

[75] Inventors: Robert E. Hawes, Jr., Huntington Bay; Manfred O. Herbst, Levittown, both of N.Y.

[73] Assignee: Esselte Pendaflex Corporation, Garden City, N.Y.

[21] Appl. No.: 556,897

[22] Filed: Jul. 23, 1990

[51] Int. Cl.[5] ..... A47B 96/00

[52] U.S. Cl. ..... 248/214; 72/379.2; 248/301

[58] Field of Search ..... 248/214, 215, 251, 301, 248/303, 304, 307, 340, 300; 312/184; 402/4; 493/947; 72/379.2; 211/46

[56] References Cited

U.S. PATENT DOCUMENTS

| | | | |
|---|---|---|---|
| 3,572,867 | 3/1971 | Cooper | 312/184 |
| 4,053,057 | 10/1977 | Snowden | 312/184 X |
| 4,114,963 | 9/1978 | Menahem | 312/184 |
| 4,420,086 | 12/1983 | Bardes | 312/184 X |
| 4,717,215 | 1/1988 | Everts | 312/184 |
| 4,722,626 | 2/1988 | Abildgaard | 312/184 X |
| 4,950,096 | 8/1990 | Gilder | 312/184 X |

*Primary Examiner*—Ramon O. Ramirez
*Attorney, Agent, or Firm*—Darby & Darby

[57] ABSTRACT

Hanging folder rods are flat strips having notches or hooks at their ends for riding on the rails of a file support frame. Notch depth is extended by long tips at the ends of the strip. By contouring the notches, extension, and end corners of the strips, the strips can be manufactured as a nested series with little void space between them. Strips nest, in one embodiment, with the top edge of one strip adjacent the bottom edge of another strip or, in another embodiment, with the bottom edges of two strips adjacent to each other. Manufacturing economy is effected by forming, for example, by stamping, the rods in the nested condition.

19 Claims, 2 Drawing Sheets

LONG TIP HANGING FOLDER RODS

FIELD OF THE INVENTION

This invention relates generally to hanging folders used in desk and standard files, and more particularly to the folder's hooked rods that engage the bars or rails of a support frame to suspend the folder in its desired position in the file.

BACKGROUND OF THE INVENTION

There is a very great use of hanging folders in filing systems by office workers, whether in professional or clerical capacity. Such folders are produced in large quantities, for example, by Esselte Pendaflex Corporation, Garden City, N.Y. The folders comprise a slightly stiffened paper sheet or board having a V-fold at its approximate center. Metal rods reinforce the folder edges that are parallel to the fold line, and the rods extend beyond the side edges of the folder. A hook shape or tip at each end of these rods is suitable for hanging the rods over horizontal bars or rails that are provided, frequently as part of a framework structure in a file cabinet or desk drawer. The weight of the folder, and its contents in use, hold the rod hooks or tips in place on the frame bars, where they are readily slidable along the length of the bars.

However, a problem arises in that the hanging folders tend to slip off the side bars, particularly when folders are pushed apart to make room for another folder, and when folders are slid along the supporting rails or bars.

Longer tips at the rod ends, effectively creating a deeper hook, would tend to resolve this problem and also prevent the rods from bending. However, rods with longer tips have not been manufactured because the rods are formed from sheets of metal. Making the tips longer in their prior art configurations creates too much waste material or too much material usage, i.e., the rods become bulkier. In either approach to the problem, more material is consumed and costs increase.

What is needed are rods for hanging folders which have longer tips without excessive scrappage and cost.

SUMMARY OF THE INVENTION

It is an object of this invention to provide improved hanging folder rods that have longer tips and are less likely to disengage, in use, from file support rails.

Another object of this invention is to provide improved hanging folder rods with extended end tips that are economical to produce.

A further object of this invention is to provide improved hanging folder rods with extended end tips that are efficient in use of raw stock materials.

In accordance with a preferred embodiment of the invention, the hanging folder rods are flat strips that have notches or hooks at their ends for riding on the rails of a file support frame. The notches are made effectively deeper by long tips, i.e. extensions, at the ends of the strip. By contouring the notches, extensions, and end corners of the strips, the strips can be manufactured as a nested series of strips with little void space between them. In one embodiment strips nest with the top edge of one strip adjacent the bottom edge of another strip. In another embodiment the bottom edges of two strips are placed adjacent to each other. The sheet material required to manufacture rods with extended tips in accordance with the invention is substantially equal to the material required to manufacture conventional rods having conventional, shorter tips. This manufacturing economy is effected by forming, for example, by stamping, the rods in a nested condition.

Other objects and advantages of the invention will be apparent from the following description. The invention accordingly comprises the features of construction, combinations of elements and arrangements of parts which will be exemplified in the constructions hereinafter set forth, and the scope of the invention will be indicated only by the appended claims.

BRIEF DESCRIPTION OF THE DRAWINGS

For a fuller understanding of the invention, reference is made to the following detailed description taken in connection with the accompanying drawings, in which.

DESCRIPTION OF THE PREFERRED EMBODIMENTS

Figure 1:
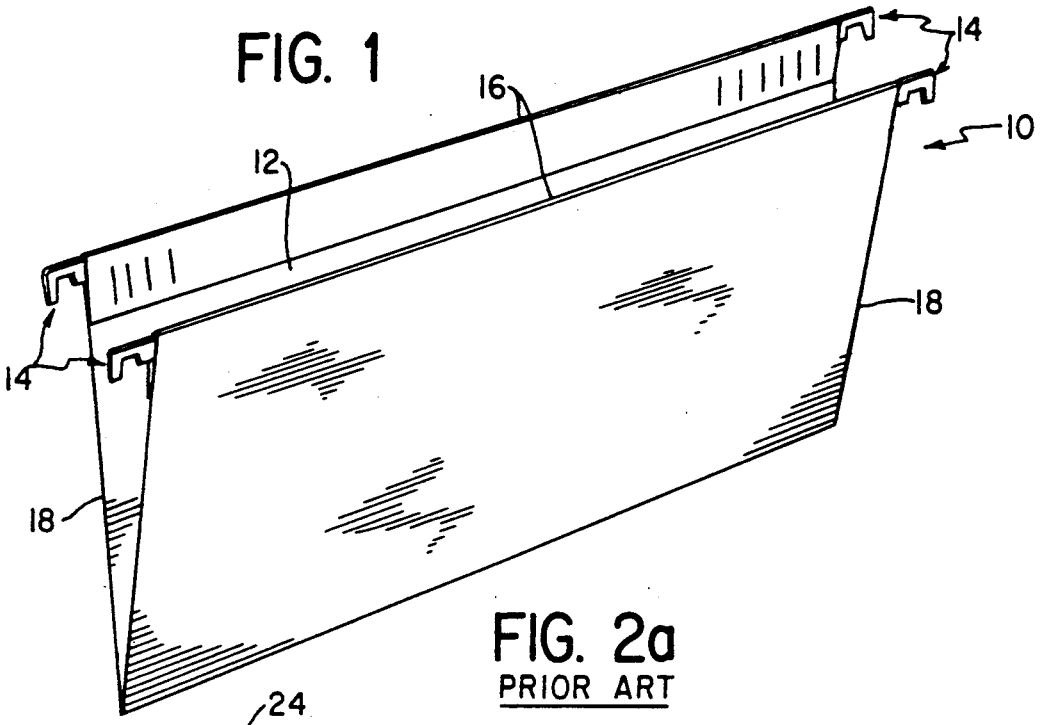
FIG. 1 is a perspective view of a hanging file folder including folder rods in accordance with the invention.

FIG. 1 illustrates a hanging file folder 10 that comprises a sharply folded sheet 12 of heavy paper having a pair of hanging rods 14 in accordance with the invention. The rods 14 extend in the lengthwise direction of the folder, parallel to the fold. They are attached to the folder edges 16 in any suitable manner. For example, a sleeve may be formed by folding the sheet 12 at the edge 16 of the folder 10 and fastening the rod in place with adhesive, staples, etc. The rods 14 are locked within the sleeve so they extend beyond the lateral edges 18 of the hanging folder 10. At the outer ends of the rods there are hook-like structures that are contoured to engage a bar or rail of a supporting frame (not shown) in a file drawer or cabinet.

Figure 2A:
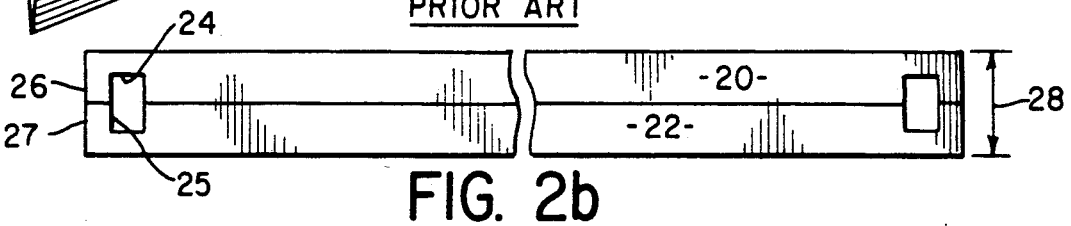
FIG. 2a PRIOR ART
FIGS. 2*a* and 2*b* are plan views of pairs of hanging folder rods of the prior art in positions relative to each other as manufactured.

FIG. 2*a* shows a pair of conventional hanging rods. The rods 20, 22 are generally rectangular thin strips of metal that have cut-out notches 24, 25 respectively, which notches are set in from the ends 26, 27, respectively, of the strips so as to form tips. In use, the notches receive the bar or rail of the supporting frame in a file drawer. The rods 20, 22 are illustrated in mirror-image position as they would be formed from a sheet of metal in a stamping operation, for example. For economy of material in manufacture, the two rods 20, 22 are in contact one with the other such that the only waste material occurs where the notches 24, 25 are punched out. In another manufacturing arrangement (not shown), the same two rods 20, 22 can be placed so the notches 24, 25 face outwardly from each other in a reversed mirror image of FIG. 2*a*. The quantity of waste material is the same in each case.

Figure 2B:
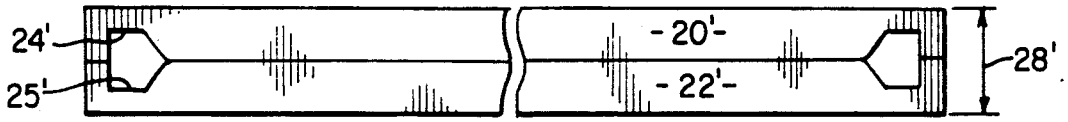
FIG. 2b PRIOR ART

FIG. 2*b* shows similar rods 20', 22' of the prior art where the notches 24', 25' are not rectangular as in FIG. 2*a*, but instead taper inwardly from the notch opening. Such a notch allows easier entry onto the supporting cabinet bar or rail, and is more tolerant of dimensional variations in such bar or rail. The quantity of scrap material which results in the manufacture of the rods 20', 22' is greater than for rods 20, 22 in that the notch area is greater in FIG. 2b. The width 28, 28' of two rods in abutting position as illustrated in FIGS. 2a, 2b is the sum of the widths of each individual rod.

Figure 3A:
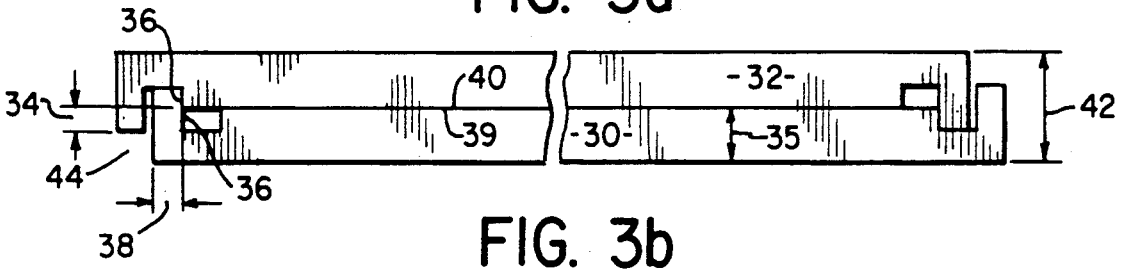
FIGS. 3*a* and 3*b* are plan views of hanging folder rods in accordance with the invention in nested positions for manufacture.

FIG. 3a is basically the rod of FIG. 2a modified, in accordance with the invention, by adding an extension 34, a longer tip, beyond the rod width 35. The extension is transverse to the rod length and increases the depth of the notch 36 on one side edge thereof. Both ends of the rod 30 have similar constructions, that is, they are mirror images of each other. The width 38 of the extended tip portion is less than the width of the notch 36 in the length direction of the rod so that during manufacture a pair of rods 30, 32 or more can be formed as a nested series of rods with one extension or tip 34 of each rod received within a notch 36 of the other rod. When the rods 30, 32 are in abutment along their lower (in use) edges 39, 40, respectively, the overall width 42 of the two rods is less than the sum of the widths of each rod taken separately. That is, the nesting reduces the overall dimensions of stock material required in manufacture to less than twice the maximum width, as compared to the prior art (FIGS. 2a, 3a) where the width dimensions at the tip set the requirement for stock material use. The material from the notches 36 is scrap in the pair of rods 30, 32 of FIG. 3a. Offsets 44 at the opposite ends of the rods 30, 32 in their abutting position slightly increase the quantity of scrap.

Thus, with a width 42 approximately equalling the width 28 of the prior art, hanging rods 30, 32 are provided with extended tips or hooks that are better able to ride on the file rails without derailing.

Figure 3B:
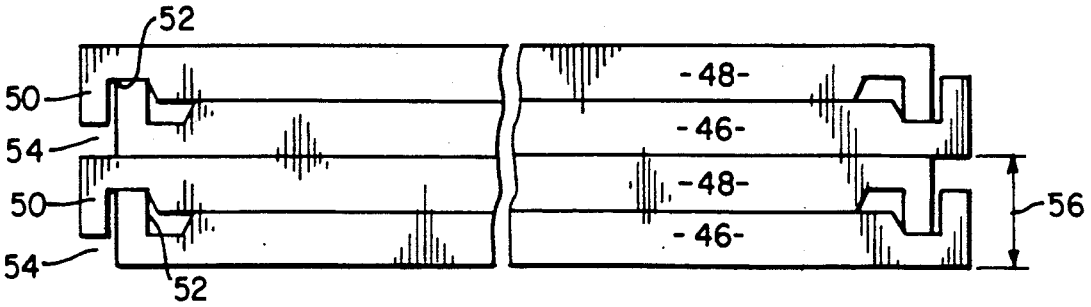

FIG. 3b illustrates rods 46, 48 that are similar to the rods 20', 22' in FIG. 2b, except for the extension 50 at the end tips of each rod. The extended tips effectively increase the depth of the notches 52 on one side thereof. When manufactured so they are abutting, as illustrated in FIG. 3b, one extended tip of each rod 46, 48 nests in the notch 52 of the adjacent rod for purposes of manufacturing economy. Again, an offset 54 results at the rod ends and the width 56 of two nested rods 46, 48 is less than the sum of the widths of the two rods taken separately.

Figure 4A:
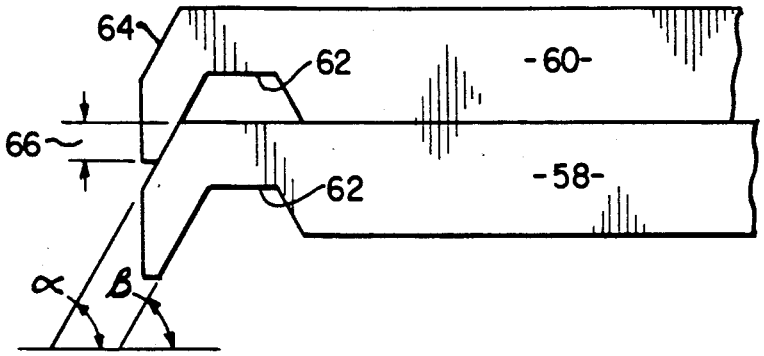
FIGS. 4*a* and 4*b* are plan views of alternative embodiments of hanging folder rods in accordance with the invention in nested positions for manufacture.
Figure 4B:
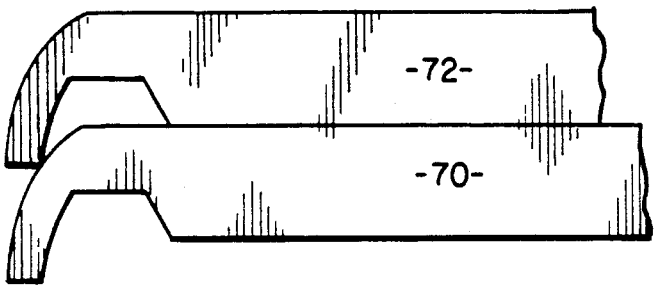

With regard to FIGS. 4a and 4b, alternative embodiments of rod pairs in accordance with the invention are illustrated where nesting for the sake of efficient manufacture is accomplished. However, in these instances, nesting is not generally achieved by locating an extended tip in the notch of a similar rod. The rods 58, 60 of FIG. 4a are similar to the conventional rods of FIG. 2b with respect to the shape of the notch 62. The right-angled end corners, which are included in the rods 20', 22', are cut-off to provide an offset 64 and an extension 66 is provided at the tip which effectively deepens the notch 62 on one side thereof. The angle $\alpha$ of the offset 64 corresponds with the angle $\beta$ for the side edge of the notch 62. Therefore, as illustrated, the rods 58, 60 nest in abutment with the extension tip 66 fitting into the offset space 64. The width 68 of two abutting rods 58, 60 is, for manufacturing purposes, less than the sum of the individual widths of each rod. All other dimensions being equal, the rods 58, 60, require no more material than the rods 20', 22' of FIG. 2b, even though longer tips are provided. The ends of the rods 58, 60 are in alignment when nested. This alignment further assists in reducing scrap during manufacture.

FIG. 4b illustrates rods 70, 72 that are similar to the rods 58, 60 (FIG. 4a) except that the hooked end is contoured with curved edges rather than straight edges. Nesting to reduce scrap in manufacture is provided.

Figure 5A:
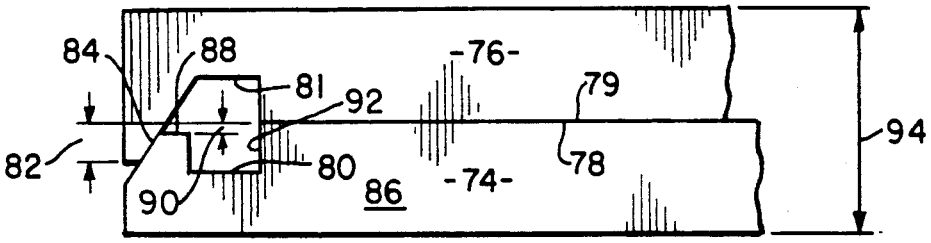
FIGS. 5*a–c* are plan views of further alternative embodiments of hanging folder rods in accordance with the invention in nested positions for manufacture.
Figure 5B:
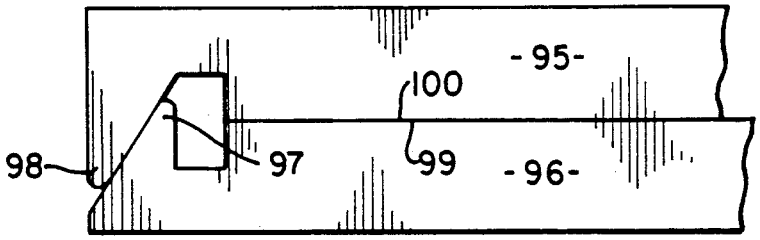
Figure 5C:
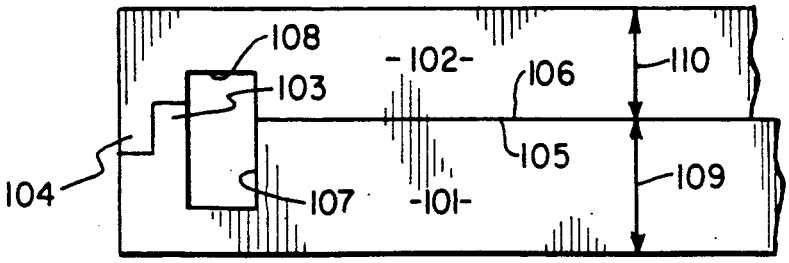

FIGS. 5a–c illustrate pairs of rods that are nested for the purpose of economic manufacture. Whereas, each rod in the rod pairs described above was identical to its associated rod, in FIGS. 5a–c different rods, that is having differences in the hooked ends and notches, are abutted when produced, for example by stamping. After production, the rods are separated by shape and used in matched sets, although mixing of rods is not precluded in use, as well as in manufacture, because the longitudinal spacing between the notches is equal. Regardless of which rod is used, sliding attachment to a cabinet rail is accomplished conventionally.

In FIG. 5a, rods 74, 76 are abutted along what would be their lower edges 78, 79 in actual use. The rod ends are in alignment and the notch 80 in the rod 74 opposes the notch 81 in the rod 76. An extension 82 of the end tip of the rod 76 rests against the sloped edge 84 at the end of the rod 74. The main body 86 of the rod 74, that is, between the notches 80 at opposite ends of the rod 74, extends beyond the tip 88 by a distance 90 such that the inner edge 92 of the notch 80 is the longer edge. By this nesting, economics in manufacture are provided as described above. It should be noted that the extension 82 on the rod 76 can be made longer than the extension 90 on the rod 74 without affecting the overall width 94 of the combination.

In FIG. 5b, two different rods 95, 96 are provided in each rod pair, the tips 97, 98 extend beyond the abutting lower edges 99, 100 of the strips. In the rods 101, 102 of FIG. 5c, the end tips 103, 104 are interlocked in a lateral direction such that the rods are different one from the other, but complementary. The extensions of the tips 104, 103 beyond the inner edges 105, 106 of the strip effectively lengthen one side of the notches 107, 108. The respective strip widths 109, 110 may be equal or unequal to each other, which affects the length of the other side of the notch.

Whereas, the strips are described as fabricated from metal sheet. In alternative embodiments in accordance with the invention they may be made from another material, for example, plastic or a composite of metal and plastic.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense. It is also to be understood that the following claims are intended to cover all of the generic and specific features of the invention herein described and all statements of the scope of the invention that might be said to fall therebetween.

What is claimed is:

1. Rods for a hanging folder, said folder being supportable on the bars or rails of a support frame in a file by a pair of said rods, each said rod comprising:

a slender strip of extended length having a top edge, bottom edge, first end and second end, and a width transverse to said length, said width extending between said top and bottom edges;

a notch spaced from each said end and extending inwardly in the width direction of said strip from said bottom edge towards said top edge, the width of said notch in the lengthwise direction of said strip allowing a bar or rail of said support frame to be received in said notch; and an extension from the bottom edge of said strip extending in a direction away from said top edge at each said strip end, each said extension being positioned between a respective strip end and notch;

a first one of said rods being dimensioned to nest edge-to-edge with a second one of said rods, the maximum width of the nested rods being less than the sum of the widths of said rods from the top surface to the end of the extension.

2. Rods for a hanging folder as claimed in claim 1, wherein, when said rods are nested with the bottom edges of their strips in contact and their ends aligned, the extensions of said one rod have a stepped cutout on the side away from the associated notch, the extensions of the other said rod being dimensioned to project into said stepped cutouts.

3. Rods for a hanging folder as claimed in claim 1, wherein, when said rods are nested with the bottom edges of the strips in contact, the rods offset one from the other in the length direction such that the extension of one fits in the notch space of the other.

4. Rods for a hanging folder as claimed in claim 3 wherein said notches are rectangular.

5. Rods for a hanging folder as claimed in claim 3 wherein said notches have a slope on an inner edge.

6. Rods for a hanging folder as in claim 1, further including recessed areas in the top edge of the strip at each end, and wherein, when said rods are nested with the top edge of one strip in contact with the bottom edge of the other strip, the ends of the strips align in the length direction and the extension of one strip fits in the recessed area of the other.

7. Rods for a hanging folder as in claim 6, wherein said first rod and said second rod are similarly contoured and dimensioned, the ends of said strips being tapered along the length of said strips near the ends and narrowing towards said top edge to form said recessed area, said extensions of said first rod strip being dimensioned to nest with said recessed area of said second rod strip when said first and second rods are positioned with the top edge of said second rod adjacent the bottom edge of said first rod.

8. Rods for a hanging folder as in claim 7, wherein the ends of said strips are perpendicular to said top edge and said strip is cut off diagonally at the intersection of said end and top edge to produce said recessed area.

9. Rods for a hanging folder as in claim 7, wherein the ends of said strip are curved between said top and bottom edges to produce said recessed area.

10. Rods for a hanging folder as in claim 1, wherein the extensions of said one rod are tapered toward the center of said one rod, the extensions of the other said rod being dimensioned to nest with said tapered extensions.

11. Rods for a hanging folder as claimed in claim 1 wherein, when said rods are nested with the bottom edges of their strips in contact and their ends aligned, the ends of the extensions of one rod are tapered diagonally to create extension recesses and the extensions of the other rod has matching tapered projections so the tapered projection nests in the extension recess.

12. Rods as claimed in claim 11 wherein the width of the strip with the extension recess is less than the width of the strip with the tapered projection, and the extensions of both are greater than their widths.

13. Rods as claimed in claim 11 wherein the width of the strip with the extension recess is greater than the width of the strip with the tapered projection, and the extension on the strip with the extension recess is smaller than the width of that strip, and the extension on the strip with the extension projection is greater than the width of that strip.

14. A method for producing hooked rods for hanging folders from a sheet of material, each said rod being a strip of extended length having a top edge, bottom edge, first end and second end, and a width transverse to said length, said width extending between said top and bottom edges, a notch spaced from each said end and extending inwardly in the width direction of said strip from said bottom edge toward said top edge, an extension from the bottom edge of said strip extending away from said top edge at each said strip end, each said extension being positioned between a respective strip end and a notch, comprising the steps of:

(a) forming a first side of a first rod by cutting through said sheet, said first side including said bottom edge, said notches and said extensions;

(b) forming a second side of said first rod by cutting through said sheet, said second side including said top edge, said top edge being shorter in length than said rod, a cut-off being provided diagonally between said top edge and each said end, respectively, of said rod;

(c) forming the second side of a second rod from said sheet by cutting through said sheet, the edge of said sheet where the top edge of said first rod was formed being the first side of said second rod, the extensions of said second rod being the portions diagonally cut away at the ends of said top edge of said first rod; and (d) forming said notches in said second rod, whereby a pair of rods is formed with a minimum of wasted sheet material.

15. The method of claim 14 and further comprising the step of:

(e) forming said rod ends by cutting said sheet for proper rod length.

16. The method of claim 15 and further comprising the step of:

(f) advancing said sheet toward said working position and repeating steps (b)–(e) to produce a series of rods.

17. A method for producing hooked rods for hanging folders from a sheet of material, each said rod being a strip of extended length having a top edge, bottom edge, first end and second end, and a width transverse to said length, said width extending between said top and bottom edges, a notch spaced from each said end and extending inwardly in the width direction of said strip from said bottom edge toward said top edge, an extension from the bottom edge of said strip extending away from said top edge at each said strip end, each said extension being positioned between a respective strip end and a notch, comprising the steps of:

(a) forming a first side of a first rod by cutting through said sheet, said first side of said first rod including said bottom edge, said notches and said extensions;

(b) completing the formation of a first side of a second rod by cutting through said sheet, said first side of said second rod including said bottom edge, said notches and said extensions, the edge of said sheet where said bottom edge of said first rod is formed being a portion of the bottom edge of the second rod, one extension on each said rod being formed of the material cut from said sheet in forming a notch of the other said rod; and (c) forming the top edges of said rods by cutting through said sheet, the edge in said sheet left from forming the top edge of said second rod being the top edge of the next first rod in said series, whereby a pair of rods is formed with a minimum of wasted sheet material.

18. The method as claimed in claim 17 and further comprising the step of:

(d) forming said ends of said rods by cutting through said sheet for proper rod length.

19. The method as claimed in claim 18 and further comprising the step of:

(e) advancing said sheet towards a working position and repeating steps a–d to produce a series of rods, the edge in said sheet left from forming the top edge of said second rod being the top edge of the next first rod in said series.

* * * * *